US008079737B2

(12) United States Patent
Wang et al.

(10) Patent No.: US 8,079,737 B2
(45) Date of Patent: Dec. 20, 2011

(54) REFLECTION-TYPE LIGHT-EMITTING MODULE WITH HIGH HEAT-DISSIPATING AND HIGH LIGHT-GENERATING EFFICIENCY

(75) Inventors: Bily Wang, Hsinchu (TW); Ping-Chou Yang, Yonghe (TW); Yu-Jen Cheng, Tainan (TW)

(73) Assignee: Harvatek Corporation, Hsinchu (TW)

( * ) Notice: Subject to any disclaimer, the term of this patent is extended or adjusted under 35 U.S.C. 154(b) by 339 days.

(21) Appl. No.: 12/426,621

(22) Filed: Apr. 20, 2009

(65) Prior Publication Data

US 2010/0264797 A1 Oct. 21, 2010

(51) Int. Cl.
*F21V 7/00* (2006.01)

(52) U.S. Cl. ..... 362/306; 362/296.1; 362/310

(58) Field of Classification Search ..... 362/296.1, 362/306, 310

See application file for complete search history.

(56) References Cited

U.S. PATENT DOCUMENTS

| | | | | |
|---|---|---|---|---|
| 6,578,998 | B2 * | 6/2003 | Zhang | 362/555 |
| 7,001,047 | B2 * | 2/2006 | Holder et al. | 362/249.04 |
| 7,246,921 | B2 * | 7/2007 | Jacobson et al. | 362/294 |
| 2004/0252502 | A1 * | 12/2004 | McCullough et al. | 362/241 |
| 2007/0279910 | A1 * | 12/2007 | Lin | 362/298 |
| 2008/0192477 | A1 * | 8/2008 | Holder et al. | 362/294 |

* cited by examiner

*Primary Examiner* — Laura Tso

(74) *Attorney, Agent, or Firm* — Muncy, Geissler, Olds & Lowe, PLLC

(57) ABSTRACT

A reflection-type light-emitting module with high heat-dissipating and high light-generating efficiency includes a reflection-type lampshade unit, a heat pipe unit and a light-emitting unit. The reflection-type lampshade unit has an open casing, a receiving space formed in the open casing, and a first reflective structure is disposed in the receiving space and on an inner surface of the open casing. The heat pipe unit is received in the receiving space and is disposed on the open casing. The light-emitting unit is disposed on the heat pipe unit, and the light-emitting unit has a light-emitting face facing the inner surface of the open casing.

17 Claims, 7 Drawing Sheets

REFLECTION-TYPE LIGHT-EMITTING MODULE WITH HIGH HEAT-DISSIPATING AND HIGH LIGHT-GENERATING EFFICIENCY

BACKGROUND OF THE INVENTION

1. Field of the Invention

The present invention relates to a reflection-type light-emitting module, in particular, to a reflection-type light-emitting module with high heat-dissipating and high light-generating efficiency.

2. Description of Related Art

Before the invention of the light bulb, illuminating the world after the sun went down was a messy, arduous, hazardous task. It took a bunch of candles or torches to fully light up a good-sized room, and oil lamps, while fairly effective, tended to leave a residue of soot on anything in their general vicinity. With the invention of the light bulb and as the science of electricity progressed in the mid 1800s, the easy-to-use lighting technology was such an improvement over the old ways that the world never looked back.

Currently, the application of illuminating devices can be categorized into two fields. One such field is the construction industry, which includes all sorts of lighting systems adapted for private housing units, commercial buildings, and public transportation systems like highways and railways, and so on, so as to achieve objects of comfort, beautification, and safety. Another such field is commercial goods, which includes all sorts of light sources adapted for auto lamps, indoor lighting, and consumer electronics, etc. As in the year 2000, the largest demand for illuminating devices lays in the United State of America. Generally, the demand for illuminating devices is growing in a rapid path following the growth of global economy. Nevertheless, as environmental awareness also grows with the global economy, it is in great demand to have green lighting systems for enhancing environmental protection and energy conservation.

Hence, how to design a light-emitting module with high heat-dissipating and high light-generating efficiency is very important problem.

SUMMARY OF THE INVENTION

In view of the aforementioned issues, the present invention provides a reflection-type light-emitting module with high heat-dissipating and high light-generating efficiency. The present invention can generate high heat-dissipating efficiency (high heat-conducting efficiency) and high light-generating efficiency (high light utilization percent) by matching a heat pipe and a plurality of types of reflective structures.

To achieve the above-mentioned objectives, the present invention provides a reflection-type light-emitting module with high heat-dissipating and high light-generating efficiency, including: a reflection-type lampshade unit, a heat pipe unit, and a light-emitting unit. The reflection-type lampshade unit has an open casing, a receiving space formed in the open casing. A first reflective structure is disposed in the receiving space and on an inner surface of the open casing. The heat pipe unit is received in the receiving space and is disposed on the open casing. The light-emitting unit is disposed on the heat pipe unit, and the light-emitting unit has a light-emitting face facing the inner surface of the open casing.

Therefore, light beams generated by the light-emitting unit are reflected outside the reflection-type lampshade unit by using the first reflective structure, so that the present invention can generate high light-generating efficiency. Heat generated by the light-emitting unit can be transmitted to the reflection-type lampshade unit by using the heat pipe unit, so that the present invention can generate high heat-dissipating efficiency.

In order to further understand the techniques, means and effects the present invention provides for achieving the prescribed objectives, the following detailed descriptions and appended drawings are hereby referred, such that, through which, the purposes, features and aspects of the present invention can be thoroughly and concretely appreciated. However, the appended drawings are merely provided for reference and illustration, without any intention to be used for limiting the present invention.

DETAILED DESCRIPTION OF THE PREFERRED EMBODIMENTS

Figure 1A:
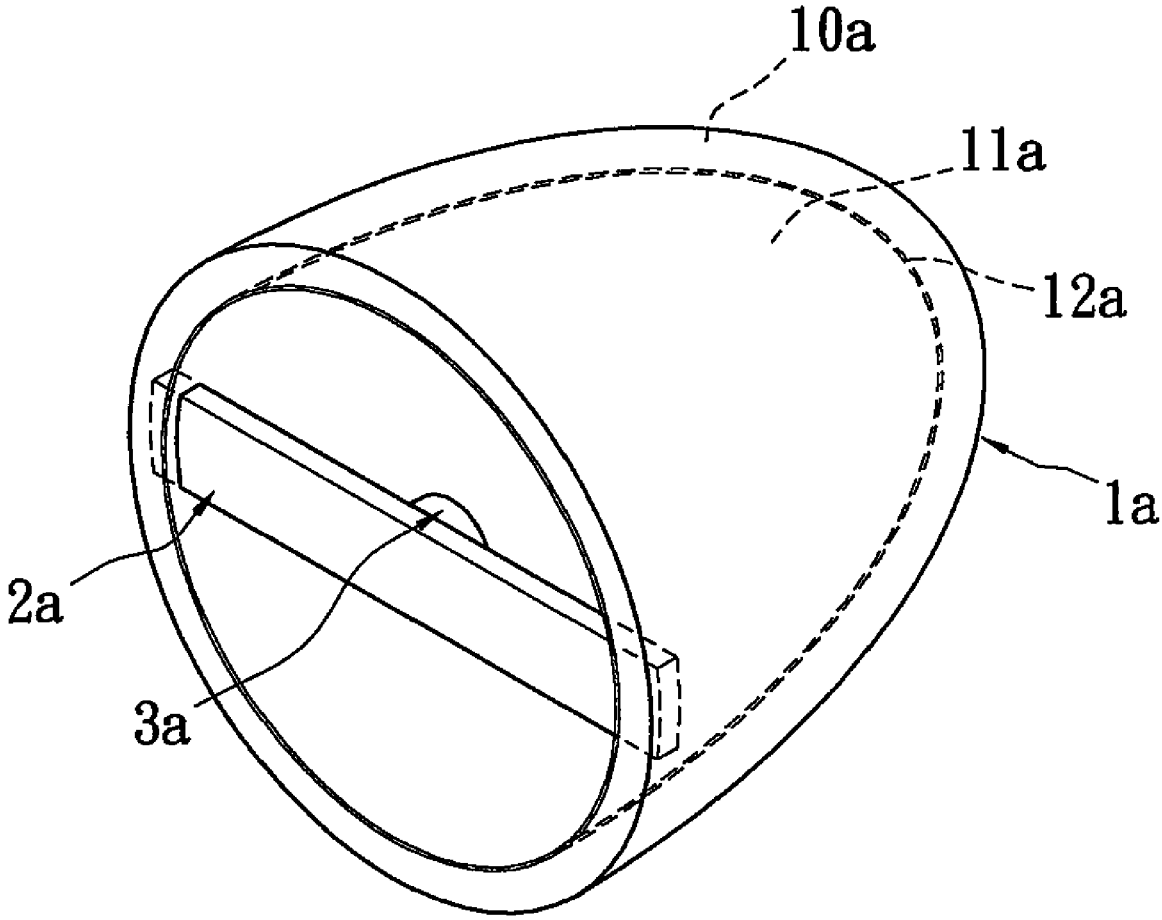
FIG. 1A is a perspective, schematic view of the reflection-type light-emitting module according to the first embodiment of the present invention.
Figure 1B:
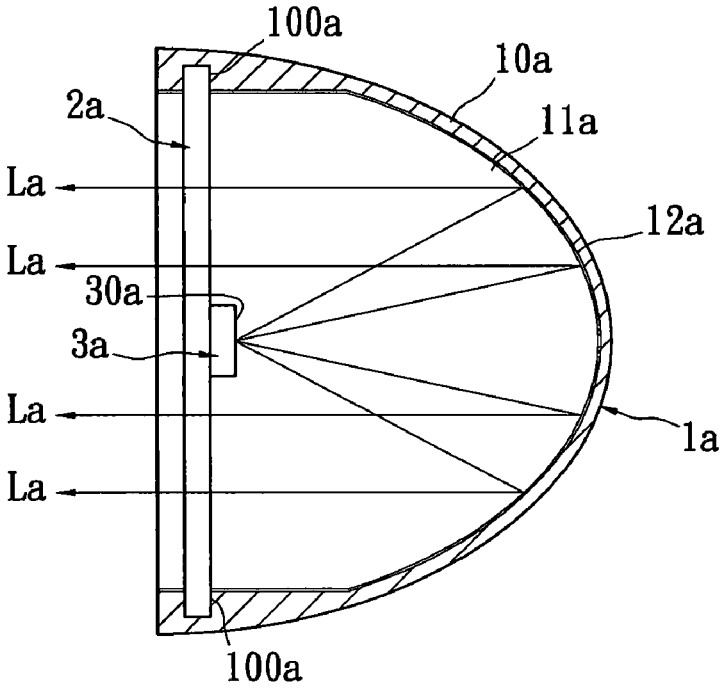
FIG. 1B is a lateral, cross-sectional, schematic view of the reflection-type light-emitting module according to the first embodiment of the present invention.

Referring to FIGS. 1A and 1B, the first embodiment of the present invention provides a reflection-type light-emitting module with high heat-dissipating and high light-generating efficiency, including a reflection-type lampshade unit 1*a*, a heat pipe unit 2*a*, and a light-emitting unit 3*a*.

The reflection-type lampshade unit 1*a* has an open casing 10*a*, a receiving space 11*a* formed in the open casing 10*a*, and a first reflective structure 12*a* disposed in the receiving space 11*a* and on an inner surface of the open casing 10*a*. In addition, in the first embodiment, the open casing 10*a* has a cup shape with an opening, and the inner surface of the open casing 10*a* can be a cambered surface. Moreover, the first reflective structure 12*a* can be a first reflective layer that is made of reflective material, and the open casing 10*a* has at least two retaining grooves 100*a* formed on the inner surface thereof.

Figure 1C:
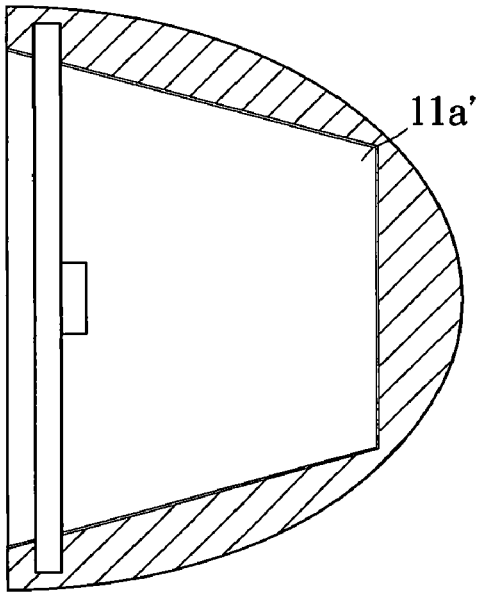
FIG. 1C is a lateral, cross-sectional, schematic view of the reflection-type light-emitting module using another type of receiving space according to the first embodiment of the present invention.
Figure 1D:
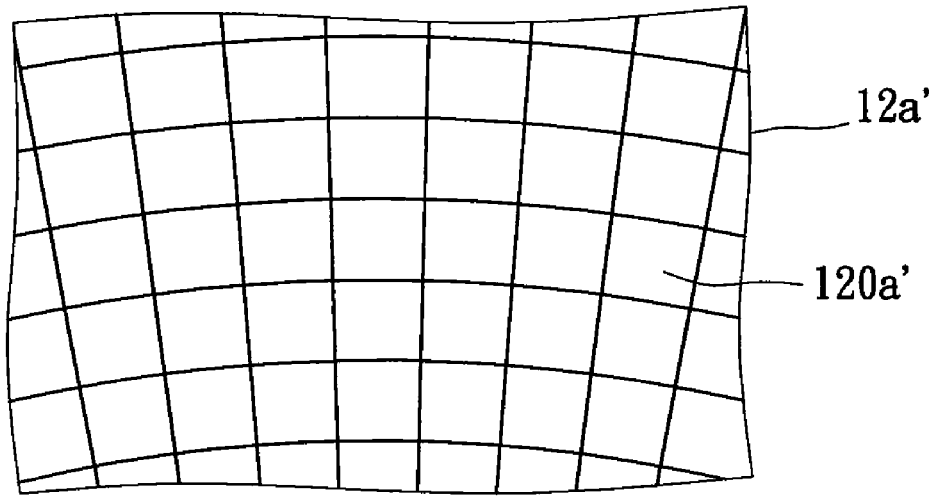
FIG. 1D is a partial, front, schematic view of the reflection-type light-emitting module using another type of first reflective structure according to the first embodiment of the present invention.

However, the shape of the open casing 10*a* and the shape of the inner surface of the open casing 10*a* are just examples, and it does not limit the present invention. For example, referring to FIG. 1C, the receiving space 11*a*' has a trapezoid shape; referring to FIG. 1D, the first reflective structure 12A' can be composed of a plurality of mirrors 120*a*', and the shape and the size of the mirror 120*a*' can be adjusted according to different requirements.

Furthermore, the heat pipe unit 2*a* can be a heat pipe. The heat pipe unit 2*a* is received in the receiving space 11*a* and disposed on the open casing 10*a*, and two opposite ends of the heat pipe unit 2*a* are respectively retained in the two retaining grooves 100*a*.

Moreover, the light-emitting unit 3*a* can be an LED. The light-emitting unit 3*a* is disposed on the heat pipe unit 2*a*, and the light-emitting unit 3*a* has a light-emitting face 30*a* facing the inner surface of the open casing 10*a*. In other words, the light-emitting unit 3*a* is disposed on a bottom face of the heat pipe unit 2*a*, and the light-emitting face 30*a* faces the first reflective structure 12*a*. In addition, the light-emitting unit 3*a* can obtain power by an electric wire along the heat pipe unit 2*a*.

Hence, light beams La generated by the light-emitting unit 3*a* are reflected outside the reflection-type lampshade unit 1*a* by using the first reflective structure 12*a*, so that the present invention can generate high light-generating efficiency. Heat generated by the light-emitting unit 3*a* can be transmitted to the reflection-type lampshade unit 1*a* by using the heat pipe unit 2*a*, so that the present invention can generate high heat-dissipating efficiency.

Figure 2:
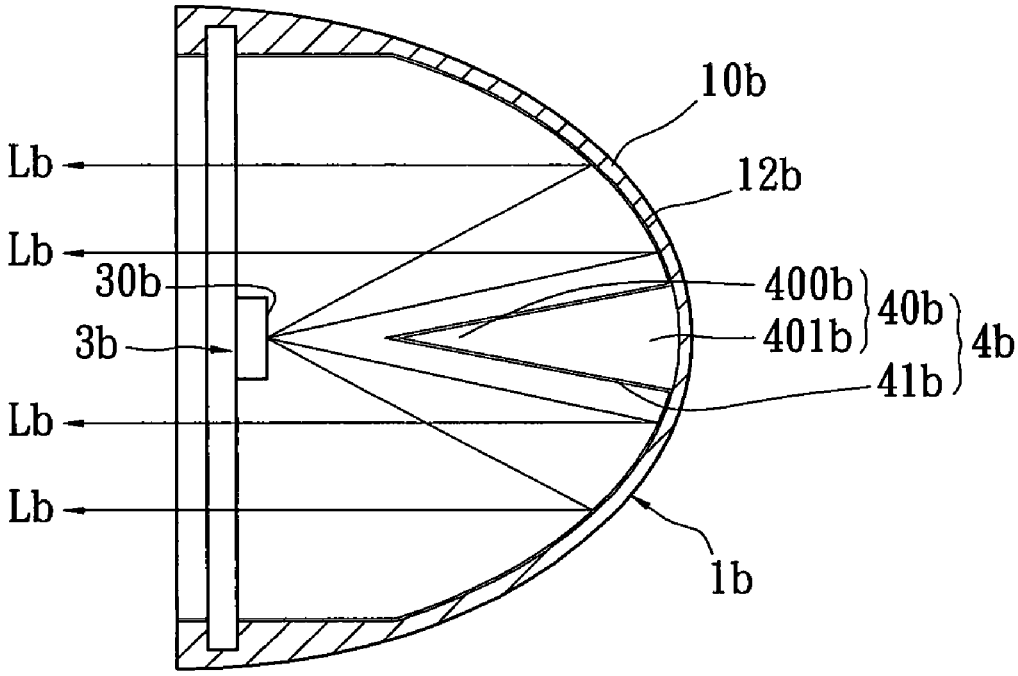
FIG. 2 is a lateral, cross-sectional, schematic view of the reflection-type light-emitting module according to the second embodiment of the present invention.

Referring to FIG. 2, the difference between the second embodiment and the first embodiment is that the second embodiment further includes a second reflective structure 4*b* disposed on the inner surface of the open casing 10*b*. The second reflective structure 4*b* has a cone 40*b* and a second reflective layer 41*b* formed on the surface of the cone 40*b*. In addition, the cone 40*b* is composed of a cone portion 400*b* and a bottom portion 401*b* disposed under the cone portion 400*b*. The cone portion 400*b* faces the light-emitting face 30*b* of the light-emitting unit 3*b*, and the bottom portion 401*b* is disposed on the inner surface of the open casing 10*b*.

Hence, light beams Lb generated by the light-emitting unit 3*b* are effectively reflected outside the reflection-type lampshade unit 1*b* by matching the first reflective structure 12*b* and the second reflective structure 4*b*, so that the light-generating efficiency of the second embodiment is better than that of the first embodiment. In addition, the shadow of the light-emitting unit 3*b* on the inner surface of the open casing 10*b* can be solved by using the second reflective structure 4*b*. When the first reflective structure 12*b* is formed on the entire inner surface of the open casing 10*b*, the second reflective structure 4*b* can be disposed on the first reflective structure 12*b* directly.

Figure 3A:
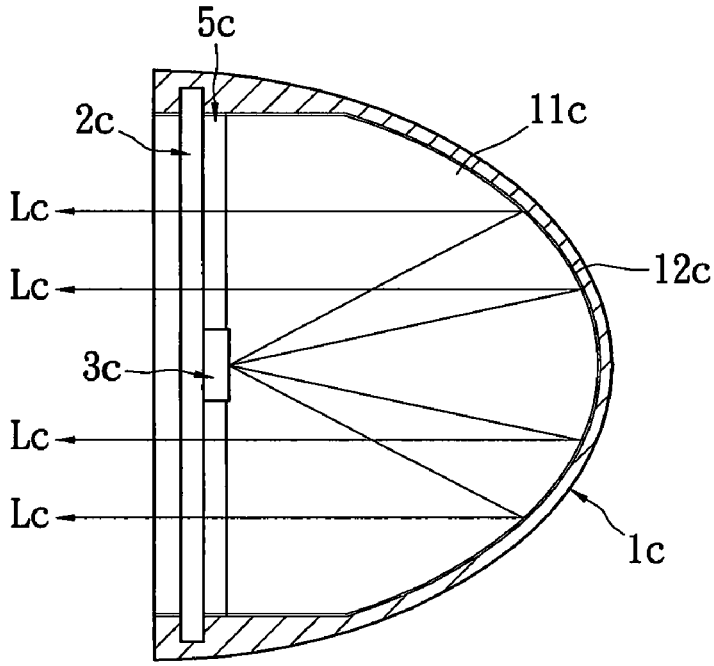
FIG. 3A is a lateral, cross-sectional, schematic view of the reflection-type light-emitting module according to the third embodiment of the present invention.
Figure 3B:
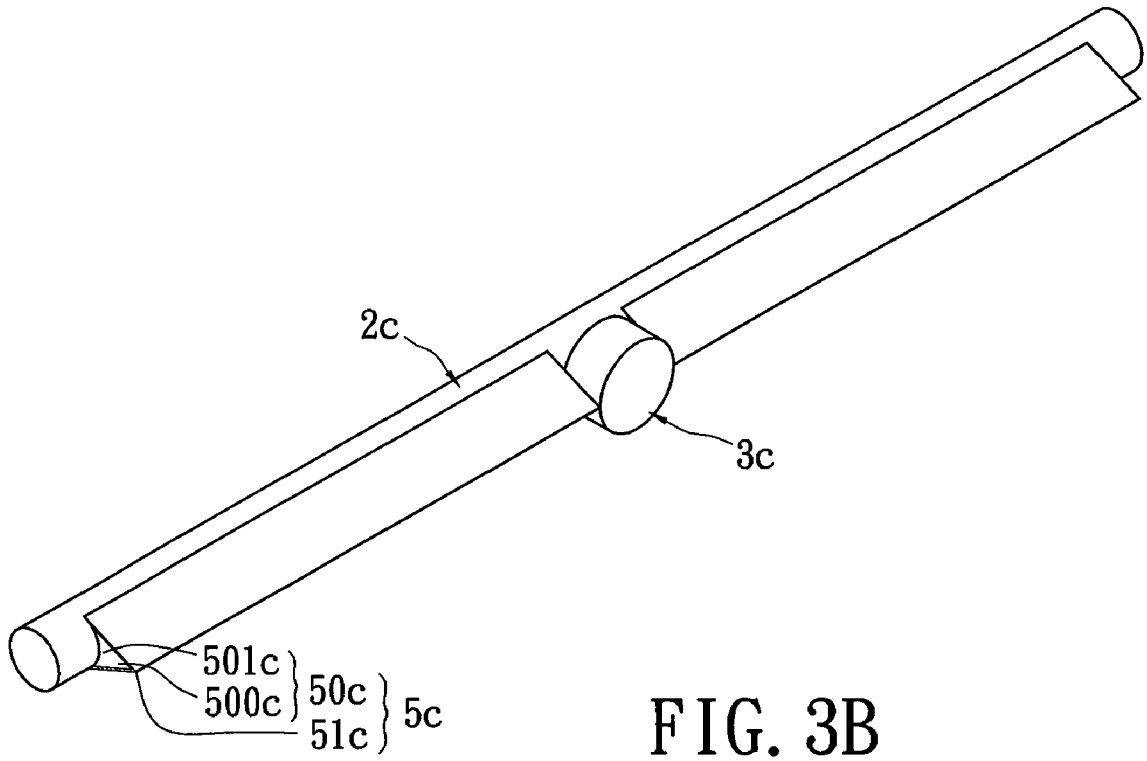
FIG. 3B is a perspective, schematic view of the third reflective structure mated with the heat pipe unit according to the third embodiment of the present invention.

Referring to FIGS. 3A and 3B, the difference between the third embodiment and above-mentioned embodiments is that the third embodiment further includes a third reflective structure 5*c* disposed on the heat pipe unit 2*c* that is received inside the receiving space 11*c*. The third reflective structure 5*c* has a cone 50*c* and a third reflective layer 51*c* formed on the surface of the cone 50*c*. In addition, the cone 50*c* is composed of a cone portion 500*c* and a bottom portion 501*c* disposed under the cone portion 500*c*. The cone portion 500*c* faces downwards the first reflective structure 12*c*, and the bottom portion 501*c* is disposed on a bottom side of the heat pipe unit 2*c*. Hence, light beams Lc generated by the light-emitting unit 3*c* are effectively reflected outside the reflection-type lampshade unit 1*c* by matching the first reflective structure 12*c* and the third reflective structure 5*c*, so that the light-generating efficiency of the third embodiment is better than that of the first embodiment.

Furthermore, the first reflective structure, the second reflective structure, and the third reflective structure can be mated with each other in order to obtain better light-generating efficiency.

Figure 4:
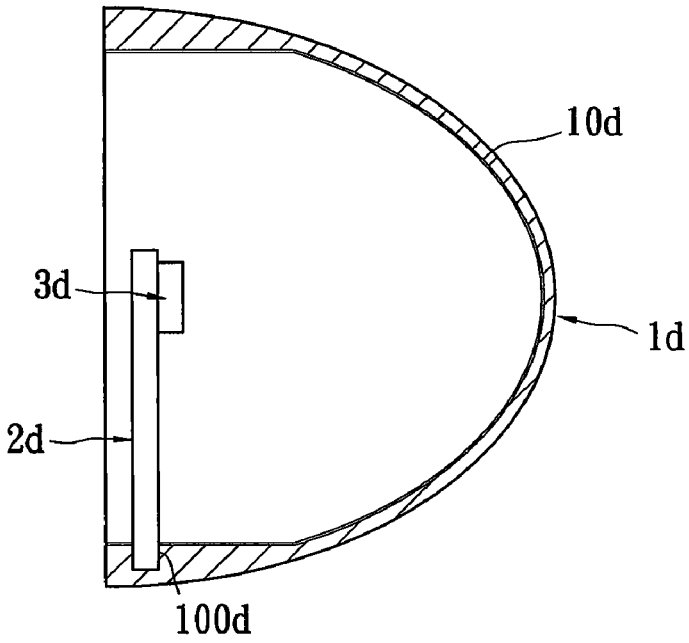
FIG. 4 is a lateral, cross-sectional, schematic view of the reflection-type light-emitting module according to the fourth embodiment of the present invention.

Referring to FIG. 4, the difference between the fourth embodiment and the first embodiment is that in the fourth embodiment, the open casing 10*d* has at least one retaining groove 100*d* formed on the inner surface thereof. One end of the heat pipe unit 2*d* is retained in the retaining groove 100*d*, and another end of the heat pipe unit 2*d* is suspended. Hence, heat generated by the light-emitting unit 3*d* can be effectively transmitted to the reflection-type lampshade unit 1*d* by using the heat pipe unit 2*d*, so that the present invention can generate high heat-dissipating efficiency.

Figure 5:
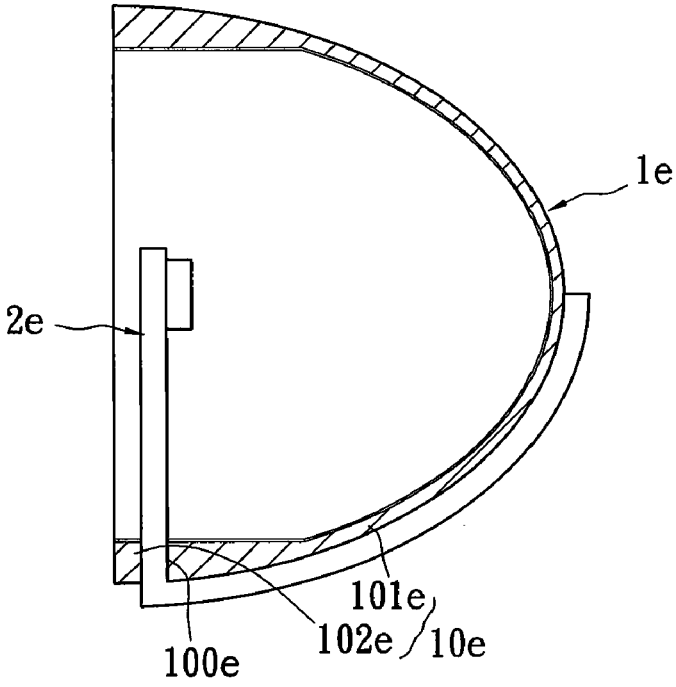
FIG. 5 is a lateral, cross-sectional, schematic view of the reflection-type light-emitting module according to the fifth embodiment of the present invention.

Referring to FIG. 5, the difference between the fifth embodiment and the fourth embodiment is that in the fifth embodiment, the reflection-type lampshade unit 1*e* has at least one through hole 100*e* passing through the open casing 10*e*. The heat pipe unit 2*e* passes through the through hole 100*e*, so that one part of the heat pipe unit 2*e* is disposed on an outer surface of the open casing 10*e*. In addition, the open casing 10*e* has a casing portion 101*e* and a base portion 102*e* disposed under the casing portion 101*e*, and the one part of the heat pipe unit 2*e* is disposed on an outer surface of the casing portion 101*e* of the open casing 10*e*.

Figure 6A:
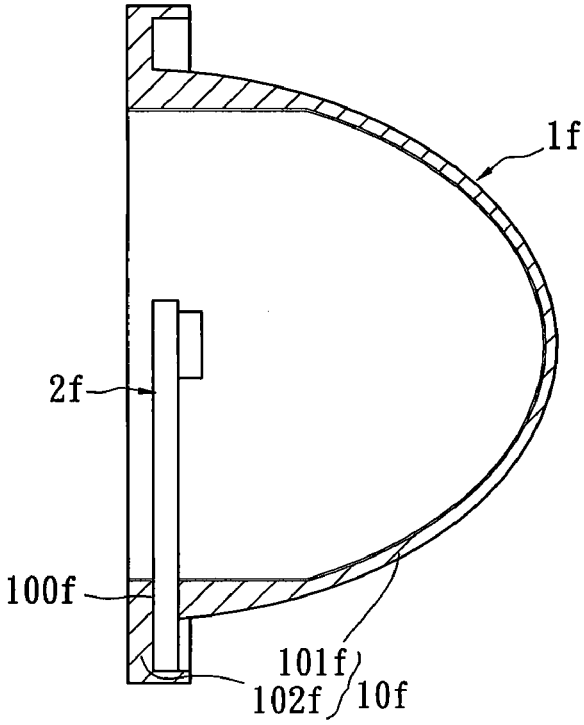
FIG. 6A is a lateral, cross-sectional, schematic view of the reflection-type light-emitting module according to the sixth embodiment of the present invention.
Figure 6B:
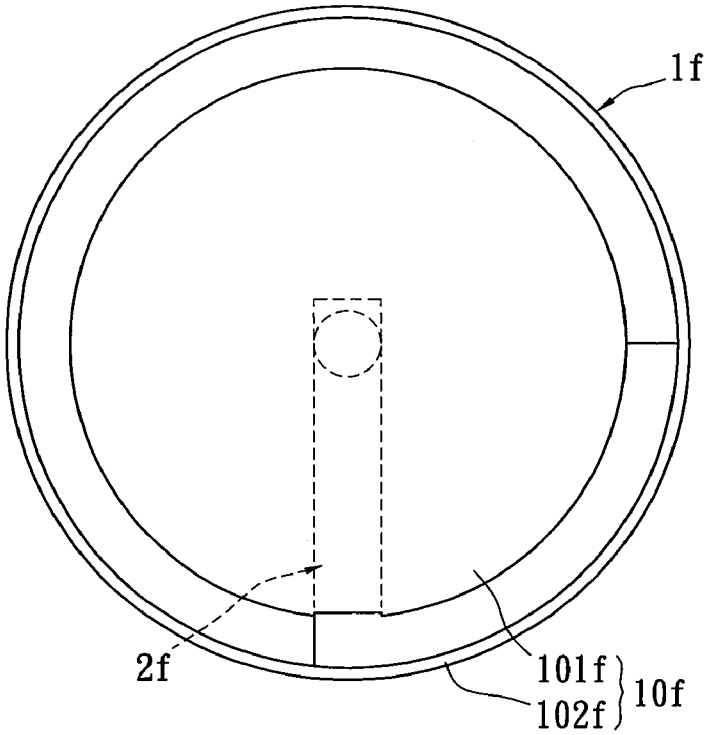
FIG. 6B is a bottom, schematic view of the reflection-type light-emitting module according to the sixth embodiment of the present invention.

Referring to FIGS. 6A and 6B, in the sixth embodiment, the reflection-type lampshade unit 1*f* has at least one through hole 100*f* passing through the open casing 10*f*. The heat pipe unit 2*f* passes through the through hole 100*f*, so that one part of the heat pipe unit 2*f* is disposed on an outer surface of the open casing 10*f*. The difference between the sixth embodiment and the fifth embodiment is that in the sixth embodiment, the open casing 10*f* has a casing portion 101*f* and a base portion 102*f* disposed under the casing portion 101*f*, and one part of the heat pipe unit 2*f* is disposed on an outer surface of the base portion 102*f* of the open casing 10*f*.

Figure 7:
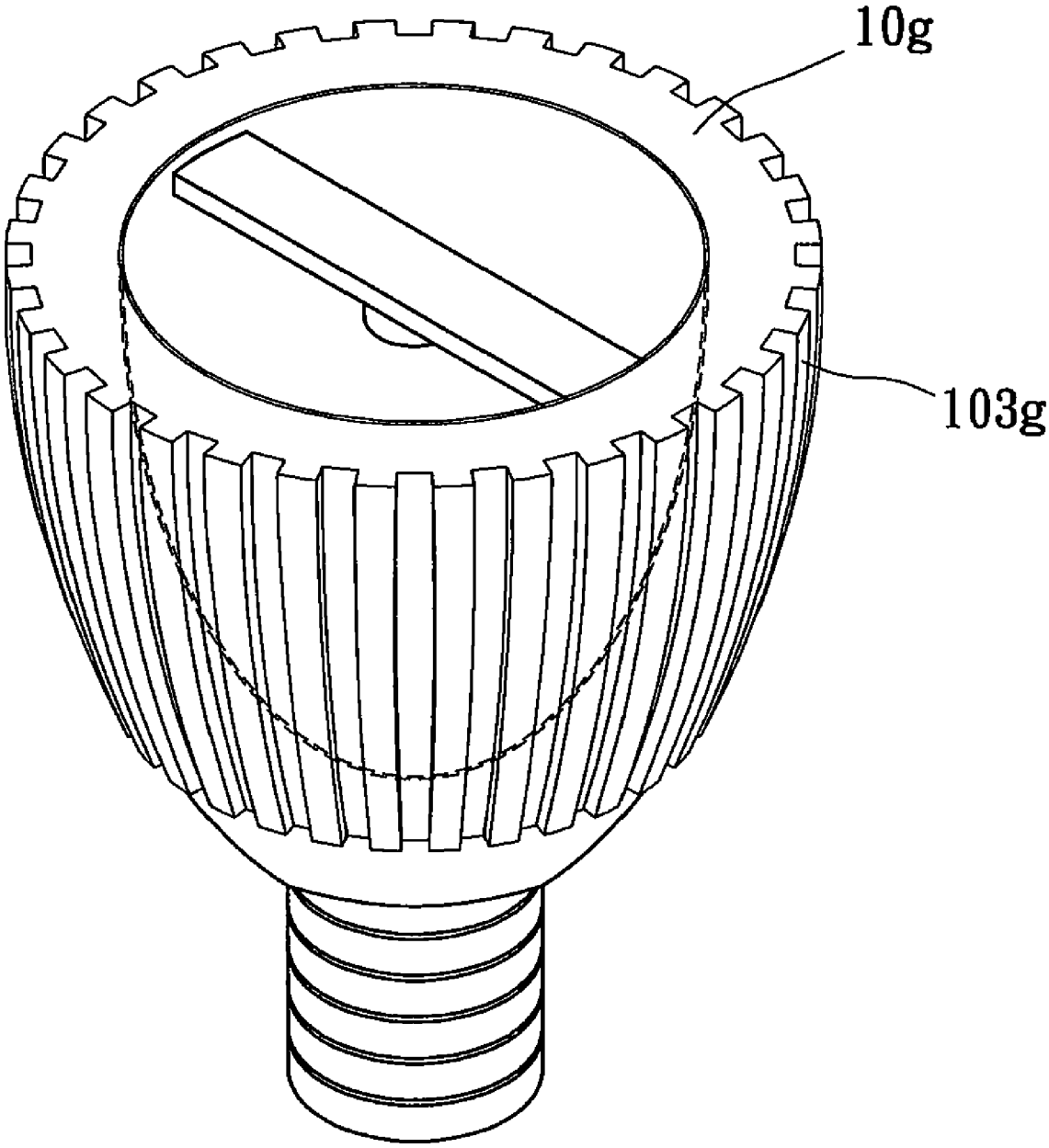
FIG. 7 is a perspective, schematic view of the reflection-type light-emitting module according to the seventh embodiment of the present invention.

Referring to FIG. 7, the difference between the seventh embodiment and above-mentioned embodiments is that the open casing 10*g* has a heat-dissipating structure 103*g* with heat-dissipating fins disposed on an outer surface thereof.

In conclusion, the present invention can generate high heat-dissipating efficiency (high heat-conducting efficiency) and high light-generating efficiency (high light utilization percent) by matching the heat pipe unit and a plurality of types of reflective structures (the first, second and third reflective structures).

The above-mentioned descriptions represent merely the preferred embodiment of the present invention, without any intention to limit the scope of the present invention thereto. Various equivalent changes, alternations or modifications based on the claims of present invention are all consequently viewed as being embraced by the scope of the present invention.

What is claimed is:

1. A reflection-type light-emitting module, comprising:

a reflection-type lampshade unit having an open casing, a receiving space formed in the open casing, and a first reflective structure disposed in the receiving space and on an inner surface of the open casing, wherein the inner surface of the open casing is a cambered surface;

a heat pipe unit received in the receiving space and disposed on the open casing; and a light-emitting unit disposed on the heat pipe unit, wherein the light-emitting unit has a light-emitting face facing the inner surface of the open casing.

2. The reflection-type light-emitting module according to claim 1, wherein the open casing has a cup shape with an opening.

3. The reflection-type light-emitting module according to claim 1, wherein the receiving space has a trapezoid.

4. The reflection-type light-emitting module according to claim 1, wherein the first reflective structure is a first reflective layer that is made of reflective material.

5. The reflection-type light-emitting module according to claim 1, wherein the first reflective structure is composed of a plurality of mirrors.

6. The reflection-type light-emitting module according to claim 1, wherein the open casing has at least two retaining grooves formed on the inner surface thereof, and two opposite ends of the heat pipe unit are respectively retained in the two retaining grooves.

7. The reflection-type light-emitting module according to claim 1, wherein the open casing has at least one retaining groove formed on the inner surface thereof, one end of the heat pipe unit is retained in the retaining groove, and another end of the heat pipe unit is suspended.

8. The reflection-type light-emitting module according to claim 1, wherein the reflection-type lampshade unit has at least one through hole passing through the open casing, and the heat pipe unit passes through the through hole, so that one part of the heat pipe unit is disposed on an outer surface of the open casing.

9. The reflection-type light-emitting module according to claim 8, wherein the open casing has a casing portion and a base portion disposed under the casing portion, and the one part of the heat pipe unit is disposed on an outer surface of the casing portion of the open casing.

10. The reflection-type light-emitting module according to claim 8, wherein the open casing is composed of a casing portion and a base portion disposed under the casing portion, and the one part of the heat pipe unit is disposed on an outer surface of the base portion of the open casing.

11. The reflection-type light-emitting module according to claim 1, further comprising: a second reflective structure disposed on the inner surface of the open casing, wherein the second reflective structure has a cone and a second reflective layer formed on the surface of the cone.

12. The reflection-type light-emitting module according to claim 11, wherein the cone is composed of a cone portion and a bottom portion under the cone portion, the cone portion faces the light-emitting unit, and the bottom portion is disposed on the inner surface of the open casing.

13. The reflection-type light-emitting module according to claim 1, further comprising: a third reflective structure disposed on the heat pipe unit, wherein the third reflective structure has a cone and a third reflective layer formed on the surface of the cone.

14. The reflection-type light-emitting module according to claim 13, wherein the cone is composed of a cone portion and a bottom portion under the cone portion, the cone portion faces downwards the first reflective structure, and the bottom portion is disposed on a bottom side of the heat pipe unit.

15. The reflection-type light-emitting module according to claim 1, wherein the open casing has a heat-dissipating structure with heat-dissipating fins disposed on an outer surface thereof.

16. A reflection-type light-emitting module, comprising:

a reflection-type lampshade unit having an open casing, a receiving space formed in the open casing, and a first reflective structure disposed in the receiving space and on an inner surface of the open casing, wherein the open casing has at least one retaining groove formed on the inner surface thereof;

a heat pipe unit received in the receiving space and disposed on the open casing, wherein one end of the heat pipe unit is retained in the retaining groove, and another end of the heat pipe unit is suspended; and a light-emitting unit disposed on the heat pipe unit, wherein the light-emitting unit has a light-emitting face facing the inner surface of the open casing.

17. A reflection-type light-emitting module, comprising:

a reflection-type lampshade unit having an open casing, a receiving space formed in the open casing, and a first reflective structure disposed in the receiving space and on an inner surface of the open casing, wherein the reflection-type lampshade unit has at least one through hole passing through the open casing;

a heat pipe unit received in the receiving space and disposed on the open casing, wherein the heat pipe unit passes through the through hole, thus one part of the heat pipe unit is disposed on an outer surface of the open casing; and a light-emitting unit disposed on the heat pipe unit, wherein the light-emitting unit has a light-emitting face facing the inner surface of the open casing.

* * * * *